US005488346A

United States Patent [19]

Kondo et al.

[11] Patent Number: 5,488,346

[45] Date of Patent: Jan. 30, 1996

[54] CONNECTION TERMINAL FOR FUSE

[75] Inventors: Hiroki Kondo; Mitsuhiko Totsuka; Toshiharu Kudo, all of Shizuoka, Japan

[73] Assignee: Yazaki Corporation, Tokyo, Japan

[21] Appl. No.: 262,865

[22] Filed: Jun. 21, 1994

[30] Foreign Application Priority Data

Jun. 21, 1993 [JP] Japan ..... 5-172050

[51] Int. Cl.[6] ..... H01H 85/02; H01H 85/52; H01H 69/02; H01R 4/48

[52] U.S. Cl. ..... 337/198; 337/194; 337/195; 337/216; 29/623; 439/830; 439/366

[58] Field of Search ..... 337/186, 187, 337/190, 198, 194, 216, 195, 295, 296; 439/250, 366, 621, 622, 830, 890; 29/623

[56] References Cited

U.S. PATENT DOCUMENTS

| | | | |
|---|---|---|---|
| 2,649,522 | 8/1953 | Marcus . | |
| 4,430,633 | 2/1984 | Ebi | 337/166 |
| 4,448,468 | 5/1984 | Coldren . | |
| 4,451,109 | 5/1984 | Inoue . | |
| 4,553,808 | 11/1985 | Weidler . | |
| 4,556,274 | 12/1985 | Olivera . | |
| 4,842,534 | 6/1989 | Mobley | 439/214 |
| 4,869,972 | 9/1989 | Hatagishi . | |
| 4,944,084 | 7/1990 | Horibe | 29/623 |
| 4,958,426 | 9/1990 | Endo et al. | 29/623 |
| 4,992,062 | 2/1991 | Nakayama | 439/621 |
| 5,049,095 | 9/1991 | Gugelmeyer | 439/856 |
| 5,106,324 | 4/1992 | Natsume | 439/510 |
| 5,294,906 | 3/1994 | Totsuka | 337/260 |

FOREIGN PATENT DOCUMENTS

| | | | |
|---|---|---|---|
| 30463608 | 6/1991 | European Pat. Off. | H01R 13/115 |
| 335640 | 4/1991 | Japan | H01H 85/56 |

*Primary Examiner*—Bot L. Ledynh
*Assistant Examiner*—Stephen T. Ryan
*Attorney, Agent, or Firm*—Sughrue, Mion, Zinn, Macpeak & Seas

[57] ABSTRACT

A connection terminal includes a pair of connection portions interconnected through a fusion portion, and each of the connection portions is defined by a bottom plate, opposite side plates formed respectively on opposite sides of the bottom plate, and a top plate. A spring portion extending from the top plate is folded back from a front side thereof to be disposed within the connection portion so that a mating connection terminal can be held between the spring portion and the bottom plate. The connection terminal is stamped from an electrically-conductive metal sheet in such a manner that the spring portion extending from the top plate is extended along and disposed generally adjacent to the fusion portion before the spring portion is folded back.

2 Claims, 5 Drawing Sheets

CONNECTION TERMINAL FOR FUSE

BACKGROUND OF THE INVENTION

1. Field of the invention

This invention relates to a connection terminal for a fuse used in an automobile or the like for protecting a load circuit against an excess current.

2. Related Art

A fuse element made of a copper alloy or the like has heretofore been used for protecting a circuit through which an excess current several times larger than a stationary current flows immediately after starting the operation as in a motor load circuit of an automobile. Such a fuse element integral with a terminal portion has been stamped from a copper alloy sheet.

However, such a copper alloy has a high fusion temperature, and therefore when a minimum operating current which causes the fuse to be fused, or a current close to it is caused to flow for a long period of time, the fusion portion is maintained at high temperatures for a long period of time, so that a problem with fuse characteristics has been encountered.

Under the circumstances, there has been made an attempt (as in a fuse disclosed in Japanese Utility Model Unexamined Publication No. 3-35640) in which a fuse is provided as a separate element, and only this element is made of low-melting metal. However, this increases the number of steps of the manufacturing process, and therefore is disadvantageous in that the cost becomes high.

Therefore, there has been made an attempt in which an integral construction is formed from a sheet of a metal alloy having a high fusion temperature, and contrivance is applied to a fusion portion, as shown in FIG. 5. FIG. 5(*a*) is a bottom view of a conventional connection terminal 51 for a fuse. The conventional connection terminal 51 for a fuse includes a fusion portion 53 of a projected configuration provided between connection portions 52A and 52B having respective curl portions 54A and 54B. FIG. 5(*b*) is a developed view of this connection terminal, and those portions (having a length Lc in their flat form) to be formed respectively into the curl portions are curled during a shaping operation to respectively form the curl portions 54A and 54B having a curvature as shown in FIG. 5(*c*) which is a front-elevational view.

In the manufacture of this connection terminal, a copper alloy sheet is stamped by a press into a developed configuration as shown in FIG. 5(*b*). However, it has been difficult to effect the stamping in such a manner that the fusion portion 53, as well as narrow interconnecting portions extending right and left respectively from the fusion portion 53, is stably formed, and therefore it has been difficult to reduce the percent defective of the stamping operation.

In view of this, if the fusion portion 53 as well as the right and left interconnecting portions is designed to be thick, the stability of the press-stamping operation is improved; however, the problem with fuse characteristics due to an increase of the fusion temperature is again encountered.

Another problem with this conventional construction is that heat-radiating properties are inferior. Generally, an electrical contact portion has an excellent thermal conductivity, and therefore heat is radiated from a heat-generating portion through the electrical contact portion. Because of this radiating effect, even if the above-mentioned minimum operating current causing the fuse to be fused, or a current close to it is caused to flow for a long period of time, a steady radiation, that is, heat removal, proceeds, thereby preventing the fusion portion from being heated to undesirable high temperatures.

With the conventional construction, however, an electrical connection between the connection portion 52A (52B) and a male terminal 60 is made at contact surfaces of the male terminal 60 held between bent distal ends of the curl portions 54A (54B), resiliently contacted therewith, and a bottom plate of the connection portion 52A (52B). When the male terminal 60 is repeatedly attached and detached, a problem arises with the contact condition, and a contact resistance is increased, so that a temperature rise (heat generation) due to the flowed current increases. As a result, the influence exerted on the fusion portion can not be disregarded. Under the circumstances, there has been made an attempt in which the bottom plate of each of the connection portions 52A and 52B is extended and is folded back to form a resilient piece portion; however, with this construction, although a high contact condition can always be maintained to improve the radiating effect, the material to be used is increased, thus inviting a drawback that the cost is increased.

SUMMARY OF THE INVENTION

The present invention has been made in order to solve the above problems and drawbacks of the conventional art, and an object of the invention is to provide a connection terminal for a fuse which achieves the stability of press-stamping, and enhances the efficiency of use of a material.

In order to achieve the above object, the present invention provides a connection terminal for a fuse characterized in that the connection terminal comprises a pair of connection portions interconnected through a fusion portion, each of the connection portions being defined by a bottom plate, opposite side plates formed respectively on opposite sides of the bottom plate, and a top plate formed by bending one of the side plates; a spring portion extending from the top plate is folded back from a front side thereof to be disposed within the connection portion so that a mating connection terminal can be held between the spring portion and the bottom plate; and the connection terminal is stamped from an electrically-conductive metal sheet in such a manner that the spring portion extending from the corresponding top plate is extended along and disposed generally adjacent to the fusion portion before the spring portion is folded back.

When manufacturing the connection terminal of the above construction for a fuse, each spring portion is formed, in a developed condition, at extra portions of the electrically-conductive metal sheet disposed forwardly of the corresponding top plate in such a manner that the spring portion is extended along and generally adjacent to the fusion portion 3. This integral construction is formed by stamping, and therefore the stamping is effected in a stable manner.

By providing such a configuration by press-stamping, the waste of the material to be used is eliminated, and particularly when manufacturing a plurality of terminals in an interconnected condition by stamping from a stock of a metal material, marked effects are obtained, and the cost can be reduced.

DETAILED DESCRIPTION OF THE PREFERRED EMBODIMENTS

A preferred embodiment of the present invention will now be described with reference to the drawings.

Figure 1:
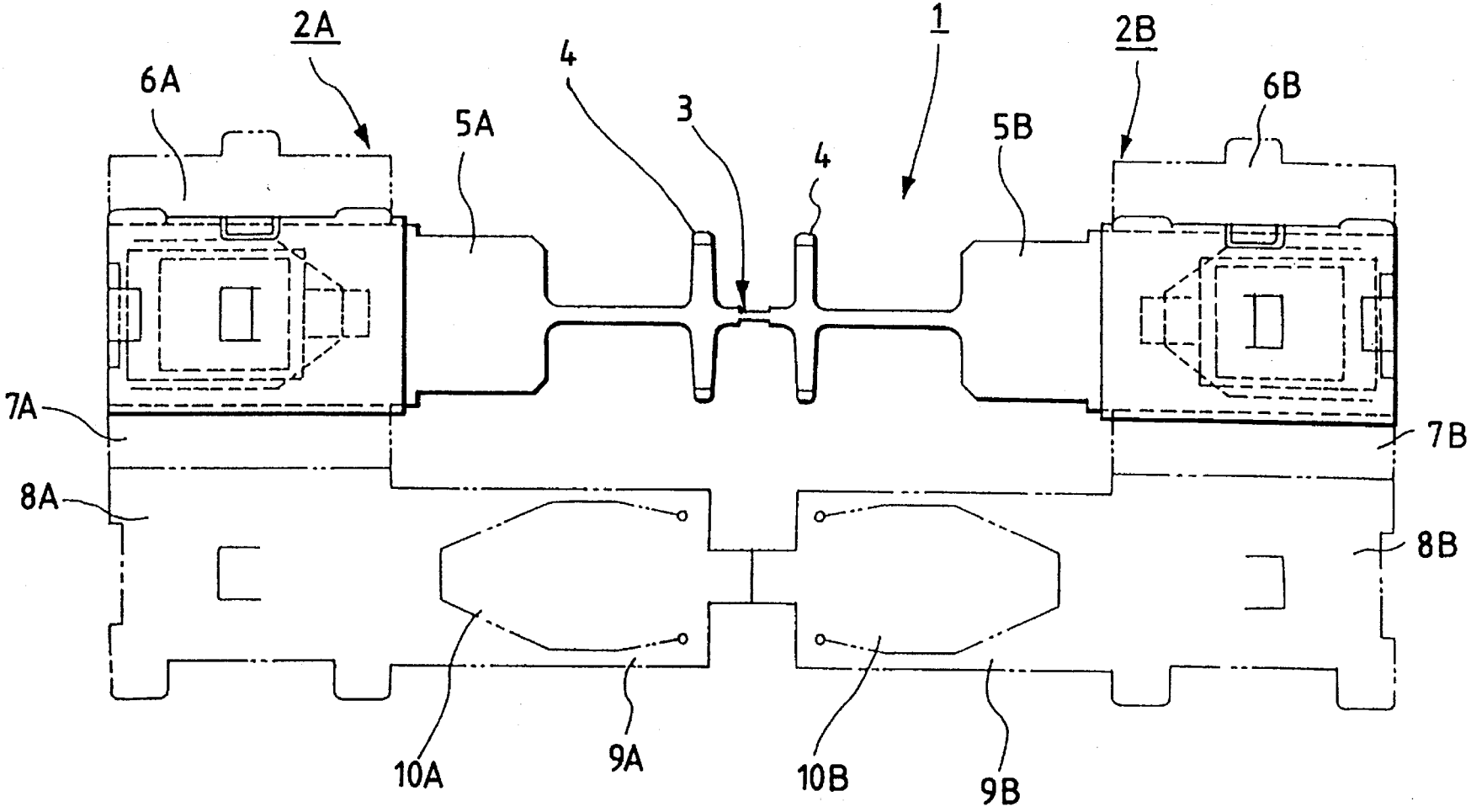
FIG. 1 is a developed view of one preferred embodiment of a connection terminal of the present invention for a fuse.
Figure 2A:
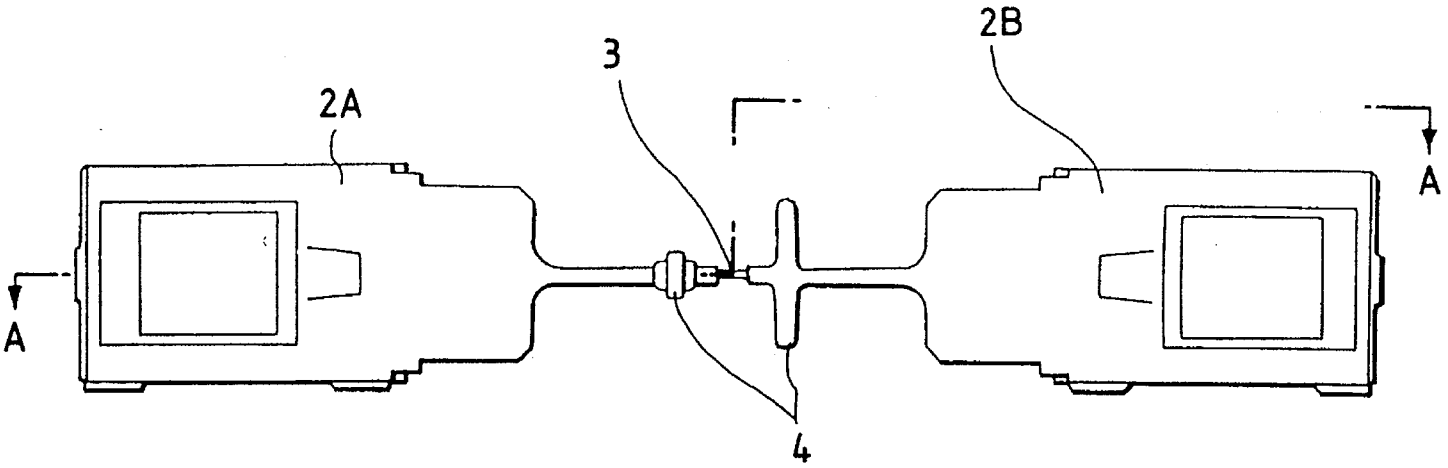
FIGS. 2(*a*), 2(*b*) and 2(*c*) are a bottom view, a side-elevational view and a front-elevational view of the fuse connection terminal of FIG. 1, respectively.
Figure 2B:
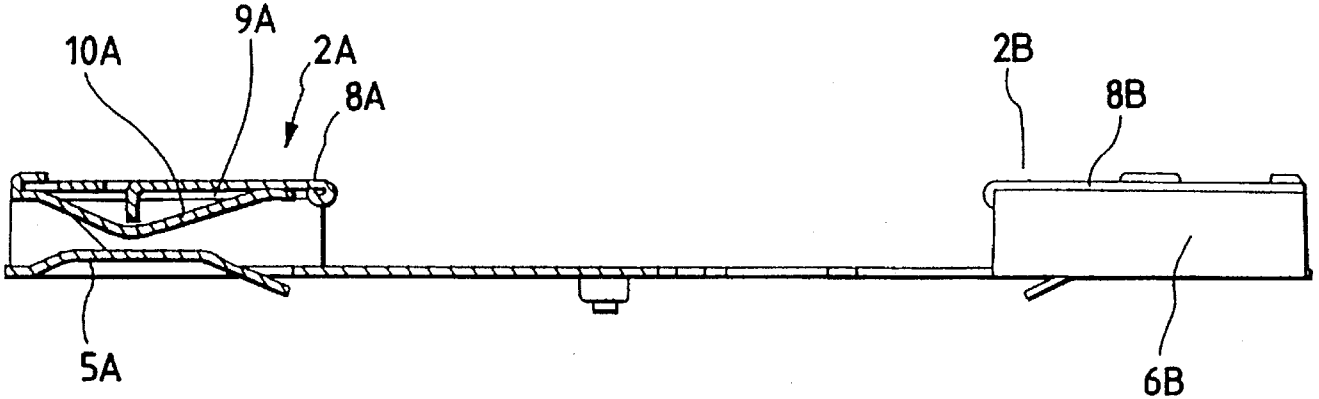
Figure 2C:
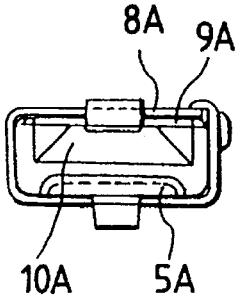

FIG. 1 is a developed view of one preferred embodiment of a connection terminal of the present invention for a fuse, and FIGS. 2(*a*), 2(*b*) and 2(*c*) are a bottom view, a side-elevational view and a front-elevational view of this connection terminal in a shaped condition.

In FIG. 1, a pair of connection portions 2A and 2B, a narrow fusion portion 3 interconnecting these connection portions, and heat-radiating projection portions 4 between which the fusion portion 3 is provided are formed by stamping from a single electrically-conductive metal sheet and then by bending. In the actual manufacture, although not shown in the drawings, a plurality of the above constructions in an interconnected condition are formed by stamping from a blank of an electrically-conductive metal sheet in an upward-downward direction.

In a developed form of the connection terminal 1 for a fuse, the connection portion 2A comprises a bottom plate 5A, opposite side plates 6A and 7A formed respectively on opposite (right and left) sides of the bottom plate 5A, a top plate 8A formed by bending the side plate 7A, and a spring portion 9A extending forwardly from the top plate 8A. The connection portion 2B is of the same construction.

On the other hand, the fusion portion 3 and the radiating projection portions 4 between which the fusion portion 3 is interposed are connected to the bottom plates 5A and 5B.

In the press-stamping as shown in the developed view of FIG. 1, the narrow fusion portion 3, the radiating projection portions 4, and narrow interconnecting portions leading respectively to the connection portions 2A and 2B are usually often subjected to undesirable deformation during the pressing operation if only these portions are provided. In the construction of the present invention, however, the spring portions 9A and 9B are formed respectively at extra portions of the electrically-conductive metal sheet disposed respectively forwardly of the top plates 8A and 8B in such a manner that these spring portions are extended along and generally adjacent to the fusion portion 3 and etc. on the lower side of the fusion portion 3, and this integral construction is obtained by stamping. By doing so, the stamping operation can be carried out stably without deforming these narrow portions.

The construction of the connection portion 2A, that is, one of the pair of the connection portions, will now be described.

The connection portion 2A has a generally box-like configuration defined by the bottom plate 5A having an inwardly projected portion, the side plates 6A and 7A formed respectively on the opposite sides of the bottom plate 5A, and the top plate 8A formed by inwardly bending the side plate 7A, the top plate 8B having a width equal to that of the bottom plate 5A. The spring portion 9A folded back at the front end of the top plate 8A is disposed within this box-like connection portion. A generally U-shaped notch is formed in the spring portion 9A to provide a spring plate 10A.

The connection portion 2A will now be described with reference to FIG. 2(*b*) which is a side-elevational view in a shaped condition. When the spring portion 9A is inwardly folded back, the spring plate 10A is resiliently projected toward the bottom plate 5A, with its end serving as a pivotal point.

In this Figure, when a mating connection terminal is inserted into the connection portion 2A from a left end thereof, this connection terminal is held between the resilient spring plate 10A and the bottom plate 5A within the connection portion 2A, so that a good electrical contact condition is achieved, and at the same time a contacted condition for heat transferring purposes is also achieved.

In this case, as shown in FIG. 2(*c*), the spring plate 10A and the bottom plate 5A can have a large width, and particularly the spring plate 10A can have a large width all over the spring portion 9A, and therefore can have a larger area, so that the area of contact with the mating connection terminal can be large. As a result, above all, the radiating effect can be much improved.

Namely, in the developed view, the above contact area can be increased without increasing the necessary material dimensions. Therefore, there can be achieved the connection terminal for a fuse which can achieve a good electrical contact condition and an excellent radiating effect without wasting the material to be used.

Figure 3:
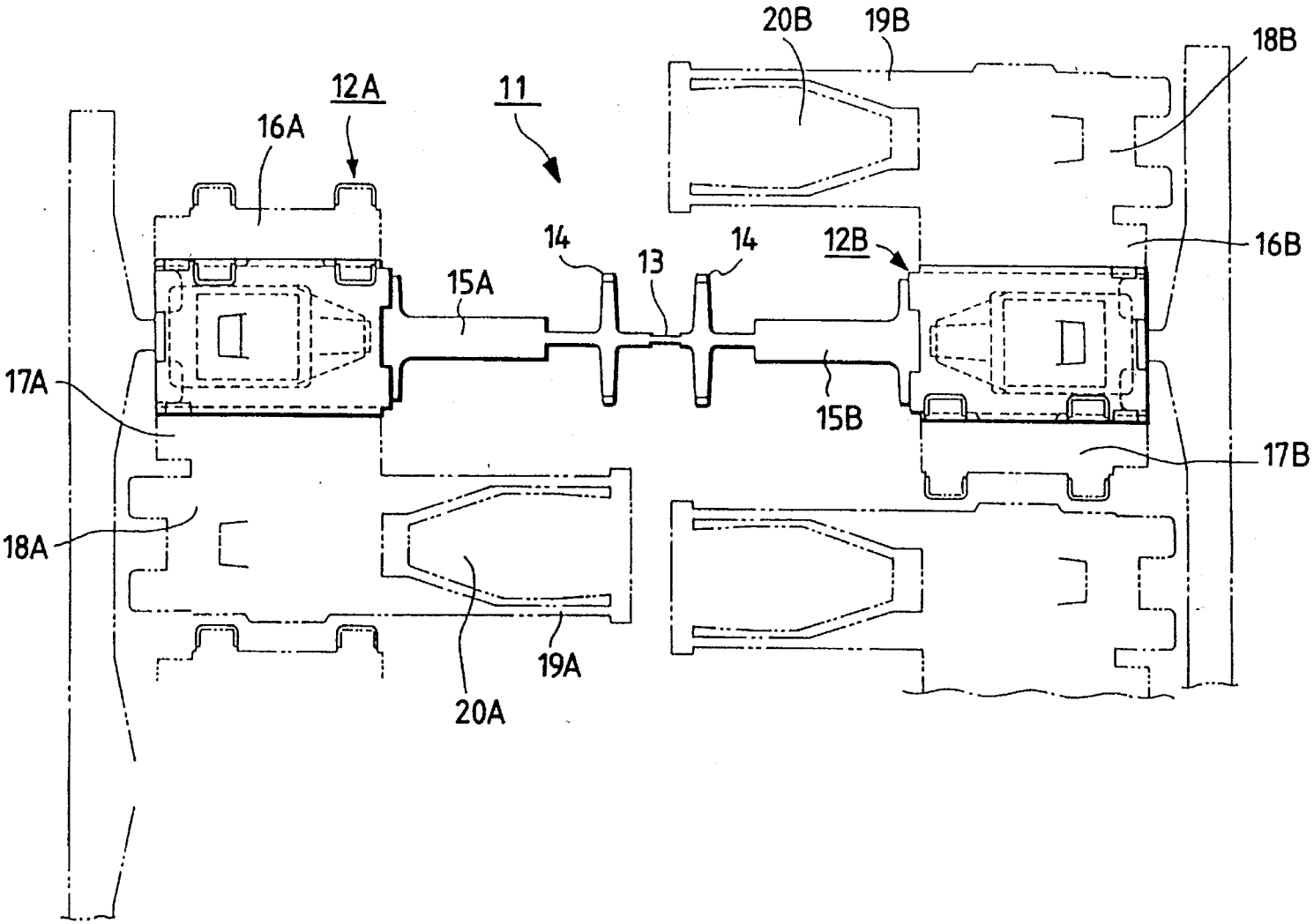
FIG. 3 is a developed view of another preferred embodiment of a connection terminal of the present invention for a fuse.
Figure 4A:
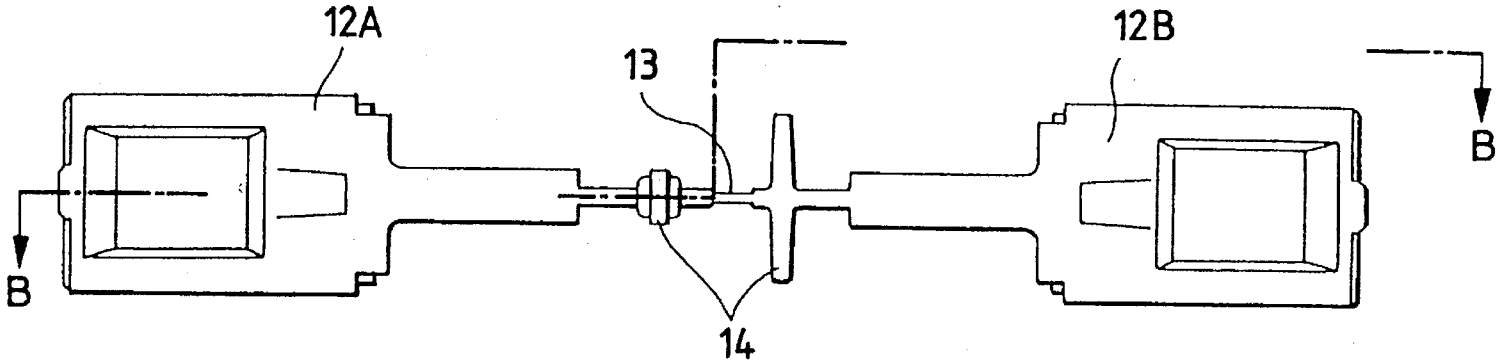
FIGS. 4(*a*), 4(*b*) and 4(*c*) are a bottom view, a side-elevational view and a front-elevational view of the fuse connection terminal of FIG. 3, respectively.
Figure 4B:
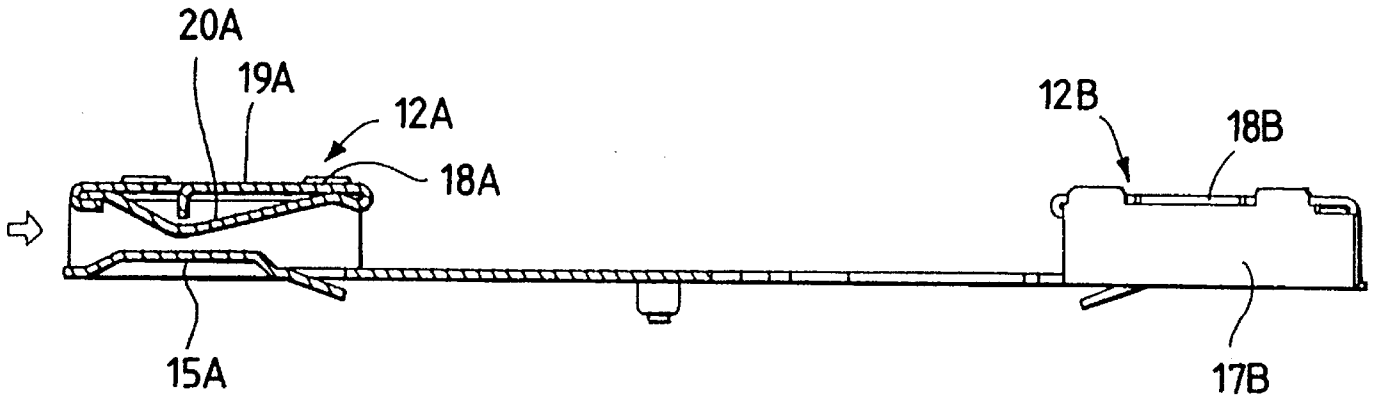
Figure 4C:
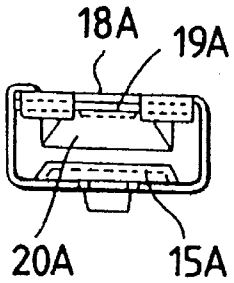
Figure 5A:
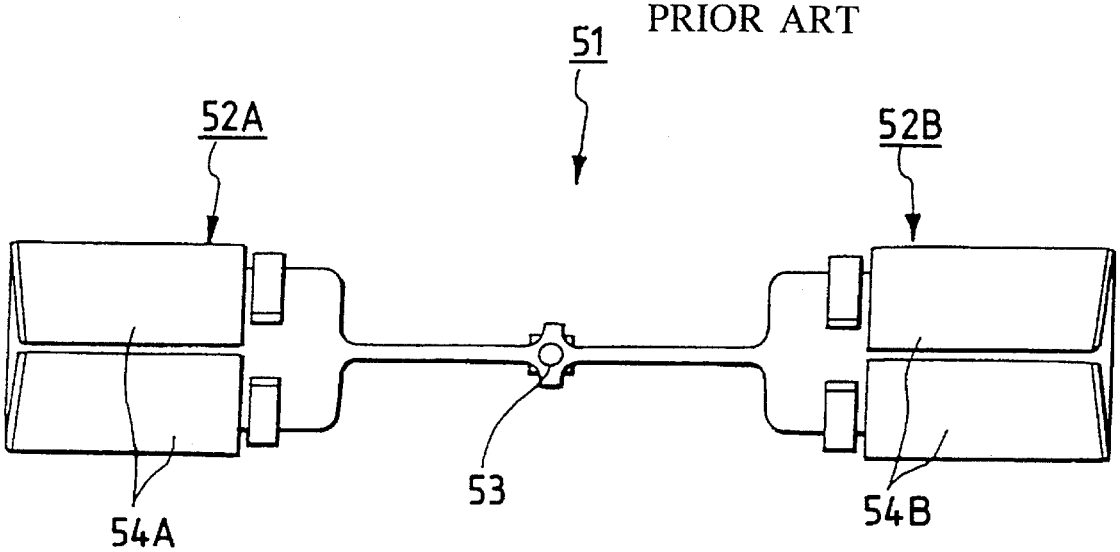
FIG. 5(a) PRIOR ART
FIGS. 5(*a*) 5(*b*) and 5(*c*) are a bottom view, a side-elevational view and a front-elevational view of a conventional connection terminal for a fuse, respectively.
Figure 5B:
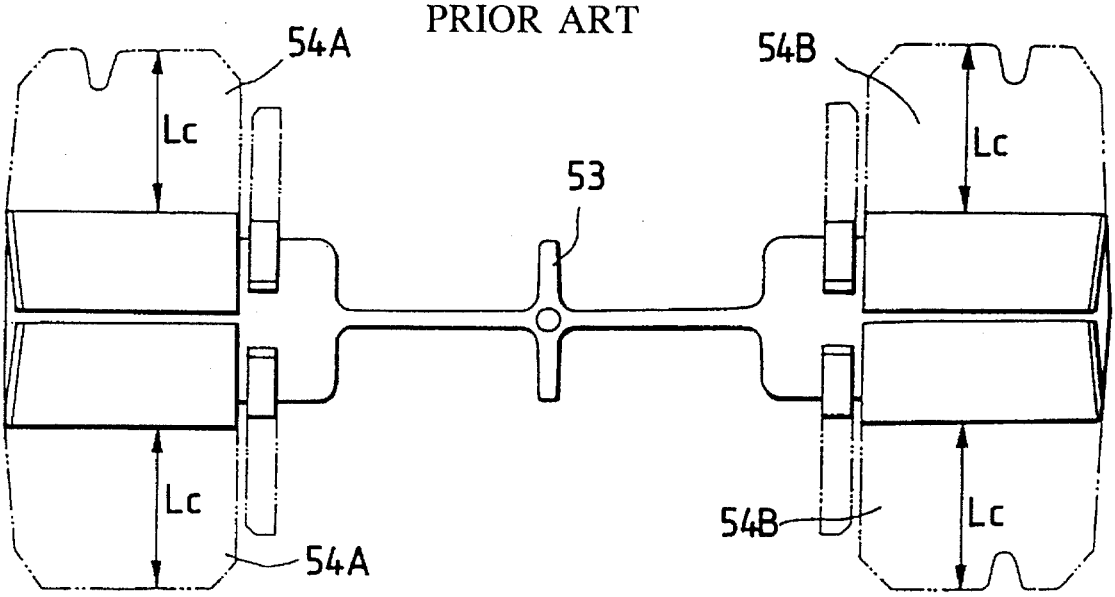
FIG. 5(b) PRIOR ART
Figure 5C:
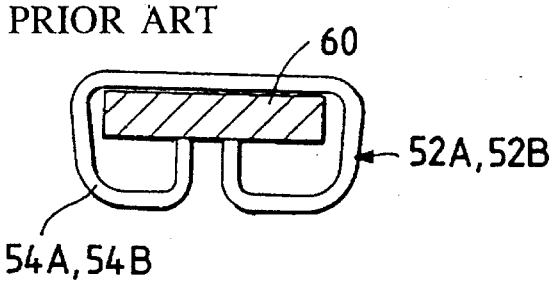
FIG. 5(c) PRIOR ART

FIG. 3 is a developed view of another preferred embodiment of a connection terminal of the present invention for a fuse, and FIGS. 4(*a*), 4(*b*) and 4(*c*) are a bottom view, a side-elevational view and a front-elevational view of this connection terminal in a shaped condition, respectively.

As is clearly seen from FIG. 3 (developed view), this embodiment greatly differs from the embodiment of FIGS. 1 and 2 in the arrangement and configuration of top plates 18A and 18B, connected respectively to a pair of connection portions 12A and 12B, and spring portions 19A and 19B extending forwardly respectively from the top plates 18A and 18B.

More specifically, in a developed form of the connection terminal 11 for a fuse, the connection portion 12A comprises a bottom portion 15A, opposite side plates 16A and 17A formed respectively on opposite (right and left) sides of the bottom plate 15A, the top plate 18A formed by bending the side plate 17A, and the spring portion 19A extending forwardly from the top plate 18A. On the other hand, the connection portion 12B includes opposite side plates 16B and 17B formed respectively on opposite (right and left) sides of a bottom plate 15B, the top plate 18B formed by bending the upper side plate 16B as contrasted with the connection portion 12A, and the spring portion 19B extending forwardly from the top plate 18B.

In the actual manufacture, a plurality of the above constructions (each including the pair of connection portions 12A and 12B, the top plates 18A and 18B and the spring portions 19A and 19B, the top plate 18A and spring portion 19A and the top plate 18B and spring portion 19B being symmetrically disposed, with the connection portions 12A and 12B generally provided therebetween) in an interconnected condition are formed by stamping from a blank of an electrically-conductive metal sheet, as partially shown in the drawings.

The other portions of the construction are generally similar to those of the preceding embodiment, respectively, and therefore explanation thereof will be omitted, with 10 added to the reference numeral of each of these corresponding portions. However, with respect to the spring portions 19A and 19B, spring plates 20A and 20B to be disposed in a projected manner respectively within the connection portions 12A and 12B are designed to be bent in opposite directions.

The connection portion 12A will now be described with reference to FIG. 4(*b*) which is a cross-sectional, side-elevational view of the connection portions 12 in the shaped condition. When the spring portion 19A is inwardly folded, the spring plate 20A is folded toward the direction of insertion of a mating connection terminal, with its end serving as a pivotal point, and is engaged in a folded-back portion 21 provided at an end of the bottom plate 15A, and the spring plate 20A is resiliently projected toward the bottom plate 15A.

Referring back to FIG. 3 (developed view), when this configuration is to be press-stamped, a little more care should be taken for the narrow interconnecting portions leading to the connection portions 12A and 12B, as compared with the integrally-shaped construction of the preceding embodiment in which the spring portions 9A and 9B are disposed along and adjacent to the fusion portion 3 and etc. on one side of the fusion portion 3. However, the stamping is effected in such a manner that the spring portions 19A and 19B are formed along the fusion portion 13 and etc., and are disposed respectively on the opposite sides thereof, and therefore the stamping can be effected in a more balanced configuration, as compared with the conventional construction in which the spring portion is formed at the top plate extending from the bottom plate. Therefore, the stamping can be stably effected without deforming the above-mentioned narrow portions. Moreover, since the spring portions 19A and 19B are disposed in a staggered manner along the fusion portion 13 and etc., on the opposite sides of the bottom plates 15A and 15B, the waste of the material can be reduced, so that the material can be used more efficiently as compared with the preceding embodiment.

In the connection terminals for a fuse according to the present invention, the fusion portion can be made sufficiently narrow as described in each of the above embodiments, and therefore when an excess current, for example, due to short-circuiting flows, the fusion portion is positively fused before a load is damaged, thereby positively breaking the circuit.

Furthermore, even if a minimum operating current or a current close to it is caused to flow for a long period of time, the fusion portion can be controlled to a low temperature by a radiating effect due to heat transfer, and therefore there is no fear that a casing and a casing cover will be melted.

As is clear from the foregoing, in the connection terminal of the invention for a fuse, the stability of the product during the press-stamping operation is enhanced to thereby reduce the percent defective, and the waste of the material to be used is eliminated, thereby reducing the cost. With respect to the operating performance, even when an excess current is produced, the fuse is positively fused before smoke is produced, thereby breaking the circuit. Also, even if the minimum operating current flows for a long period of time, an accident such as the melting of the casing and the casing cover will not occur. Thus, a plurality of advantageous effects can be achieved at the same time.

As described above, in the connection terminals of the present invention for a fuse, the connection portions are interconnected through the fusion portion, and the spring portion of each connection portion extending from the top plate is folded back from the front side thereof so that the mating connection terminal can be held between the spring portion and the bottom plate. This connection terminal is stamped from the electrically-conductive metal sheet in such a manner that the spring portion extending from the corresponding top plate is extended along and disposed generally adjacent to the fusion portion before the spring portion is folded back. With this arrangement, the stability of the product during the press-stamping is enhanced, thereby reducing the percent defective to thereby reduce the cost, and besides the waste of the material to be used is eliminated, thereby further reducing the cost.

The electrical connection of each connection portion to the inserted mating connection terminal is achieved within its generally box-like structure, and therefore this construction is less influenced by an external force and the like as compared with a so-called fasten-type construction, as described in the conventional art, in which the pair of curl portions are exposed, and therefore the contact reliability is high.

What is claimed is:

1. A connection terminal for a fuse comprising:

a unitary structure including a pair of connection members interconnected through a fusion portion, each of said connection members including a bottom plate, opposite side plates formed respectively on opposite sides of said bottom plate, a top plate extended continuously from one of opposite side plates and a spring member disposed within the top plate and extending from a front side thereof so as to hold a terminal between said spring portion and said bottom plate.

2. A connection terminal for a fuse as claimed in claim 1, wherein said connection terminal is stamped from an electrically-conductive metal sheet in such a manner that said spring portion is disposed generally adjacent to said fusion portion before said spring portion is folded back.

* * * * *